US009416799B2

(12) United States Patent
Danzl et al.

(10) Patent No.: US 9,416,799 B2
(45) Date of Patent: Aug. 16, 2016

(54) METHODS AND SYSTEMS FOR FLOW SHARING IN A HYDRAULIC TRANSFORMER SYSTEM WITH MULTIPLE PUMPS

(71) Applicant: Eaton Corporation, Cleveland, OH (US)

(72) Inventors: Per William Danzl, Edina, MN (US); Vishal Vijay Mahulkar, Eden Prairie, MN (US)

(73) Assignee: Eaton Corporation, Cleveland, OH (US)

( * ) Notice: Subject to any disclaimer, the term of this patent is extended or adjusted under 35 U.S.C. 154(b) by 334 days.

(21) Appl. No.: 14/212,320

(22) Filed: Mar. 14, 2014

(65) Prior Publication Data

US 2014/0260232 A1 Sep. 18, 2014

Related U.S. Application Data

(60) Provisional application No. 61/791,895, filed on Mar. 15, 2013, provisional application No. 61/798,649, filed on Mar. 15, 2013.

(51) Int. Cl.

| | |
|---|---|
| ***F15B 21/08*** | (2006.01) |
| ***E02F 9/22*** | (2006.01) |
| ***E02F 9/26*** | (2006.01) |

(Continued)

(52) U.S. Cl.

CPC ..... *F15B 21/087* (2013.01); *E02F 9/2203* (2013.01); *E02F 9/2217* (2013.01);

(Continued)

(58) Field of Classification Search

CPC ..... E02F 9/2217; E02F 9/2235; E02F 9/2282; E02F 9/2203; E02F 9/2292; E02F 9/2296; E02F 9/265; F15B 1/024; F15B 21/087; F15B 21/14; F15B 2211/20546; F15B 2211/20576; F15B 2211/212; F15B 2211/214; F15B 2211/30595; F15B 2211/6313; F15B 2211/6654; F15B 2211/7053; F15B 2211/7058; F15B 2211/7135; F15B 2211/7142; F15B 2211/88

USPC ..... 60/417, 418, 419

See application file for complete search history.

(56) References Cited

U.S. PATENT DOCUMENTS

| | | | | |
|---|---|---|---|---|
| 7,409,826 | B2 * | 8/2008 | Epshteyn | F16D 31/00 60/414 |
| 2004/0107699 | A1 | 6/2004 | Fales et al. | |
| 2013/0152565 | A1 * | 6/2013 | Ma | F15B 21/14 60/327 |

FOREIGN PATENT DOCUMENTS

| | | | |
|---|---|---|---|
| WO | WO 2012/166022 | A1 | 12/2012 |
| WO | WO 2013/025459 | A1 | 2/2013 |

OTHER PUBLICATIONS

International Search Report and Written Opinion for PCT/US2014/029190 mailed Jul. 29, 2014.

*Primary Examiner* — Nathaniel Wiehe
*Assistant Examiner* — Logan Kraft
(74) *Attorney, Agent, or Firm* — Merchant & Gould P.C.

(57) ABSTRACT

To achieve flow demands for high flow services, a hydraulic system shares a flow between a hydraulic transformer and one or more hydraulic pumps. The hydraulic transformer is in selective fluid communication with the pumps and actuates a first load. A second load is driven by an actuator in selective fluid communication with the pumps and the hydraulic transformer. The hydraulic system includes a controller to reduce dynamic responses in the system by causing flow sharing between the hydraulic transformer and a directional flow control valve.

14 Claims, 6 Drawing Sheets

(51) Int. Cl.
*F15B 21/14* (2006.01)
*F15B 1/02* (2006.01)

(52) U.S. Cl.
CPC ..... *E02F9/2235* (2013.01); *E02F 9/2285* (2013.01); *E02F 9/2292* (2013.01); *E02F 9/2296* (2013.01); *E02F 9/265* (2013.01); *F15B 21/14* (2013.01); *F15B 1/024* (2013.01); *F15B 2211/20546* (2013.01); *F15B 2211/20576* (2013.01); *F15B 2211/212* (2013.01); *F15B 2211/214* (2013.01); *F15B 2211/30595* (2013.01); *F15B 2211/6303* (2013.01); *F15B 2211/6654* (2013.01); *F15B 2211/7053* (2013.01); *F15B 2211/7058* (2013.01); *F15B 2211/7135* (2013.01); *F15B 2211/7142* (2013.01); *F15B 2211/88* (2013.01)

METHODS AND SYSTEMS FOR FLOW SHARING IN A HYDRAULIC TRANSFORMER SYSTEM WITH MULTIPLE PUMPS

RELATED APPLICATIONS

This application claims the benefit of U.S. Patent Application Ser. No. 61/791,895 filed on Mar. 15, 2013, and U.S. Patent Application Ser. No. 61/798,649 filed on Mar. 15, 2013. The entireties of these applications are hereby incorporated by reference.

INTRODUCTION

Mobile pieces of heavy machinery (e.g., excavators, backhoe loaders, wheel loaders, etc.) often include hydraulic systems having hydraulically powered linear and rotary actuators used in conjunction with hydraulic transformers to power various active machine components (e.g., swing, boom, dipper, bucket, linkages, tracks, rotating joints, etc.). By accessing a user interface of a machine control system, a machine operator controls the machinery to perform work (e.g., earthmoving).

In hybrid systems, hydraulic transformers are sometimes coupled to external loads (e.g., via a shaft) which require precise speed control. Throughout the work cycle, hydraulic transformers may provide a motoring function or a pumping function where torque is transferred either to or from a shaft, an external load, and/or energy storage devices (e.g., accumulator). Since pump motors have finite displacement capabilities, a hydraulic system cannot always realize a high flow demand at a specific rotational speed, such as, for example, when a system is utilized to lift or move a work element (e.g., a boom) against a force of gravity. In such hybrid work circuits, there is often a need to optimally achieve flow demand to one or more hydraulic actuators when the flow is supplied by a hydraulic transformer and one or more pump motors. In addition, such flow demand should be accomplished smoothly so as to be transparent to an operator of the machinery to enable maximum fuel efficiency and productivity.

SUMMARY

Aspects of the present disclosure relate to systems and methods for effectively flow sharing in a hydraulic system between a hydraulic transformer and one or more hydraulic pumps to achieve flow demands for high flow services.

One aspect is a hydraulic system including a tank, at least one system pump, a first directional flow control valve, an accumulator, a hydraulic transformer, a second load, and a controller. The at least one system pump is powered by at least one prime mover and coupled to the tank. The first directional flow control valve is coupled to the at least one system pump. The hydraulic transformer is in selective fluid communication with the at least one system pump and includes first and second displacement pump units connected to a shaft. The shaft is connected to a first load. The first displacement pump unit includes a first side that selectively fluidly connects to at least one of the at least one system pump and a second side that fluidly connects to the tank. The second displacement pump unit includes a first side that fluidly connects to the accumulator and a second side that fluidly connects with the tank. The second load is driven by an actuator in selective fluid communication with the at least one system pump and the hydraulic transformer. The controller is arranged and configured to reduce dynamic responses in the hydraulic system by causing flow sharing between the hydraulic transformer and the first directional flow control valve.

The controller has a memory with a set of instructions. The controller is arranged and configured to execute the set of instructions to implement a method for flow sharing. The method may include: receiving and reading operator inputs; computing a load value indicative of the second load based on the pressure measurements; computing a desired flow based on the load value; determining whether the hydraulic transformer is sufficient to independently supply the desired flow; if the hydraulic transformer is not sufficient to independently supply the desired flow: computing a flow deficit; computing and sending a command to the first directional flow control valve indicative of the flow deficit; and if the hydraulic transformer is sufficient to independently supply the desired flow: computing a desired displacement for the hydraulic transformer; and computing and sending a second transformer command to the hydraulic transformer to realize the desired displacement.

DETAILED DESCRIPTION

Reference will now be made in detail to aspects of the present disclosure that are illustrated in the accompanying drawings. Wherever possible, the same reference numbers will be used throughout the drawings to refer to the same or like structure.

In general, the systems and methods below describe hybrid hydraulic systems for increased fuel efficiency while maintaining operator transparency during operation of machinery utilizing such hybrid hydraulic systems. In particular, operator transparency may be achieved by reduction of undesirable dynamic responses due to inadequate and/or inefficient scheduling of flow sources. In some embodiments, this is accomplished by flow sharing between multiple sources, each capable of contributing different amounts of flow.

Figure 1:
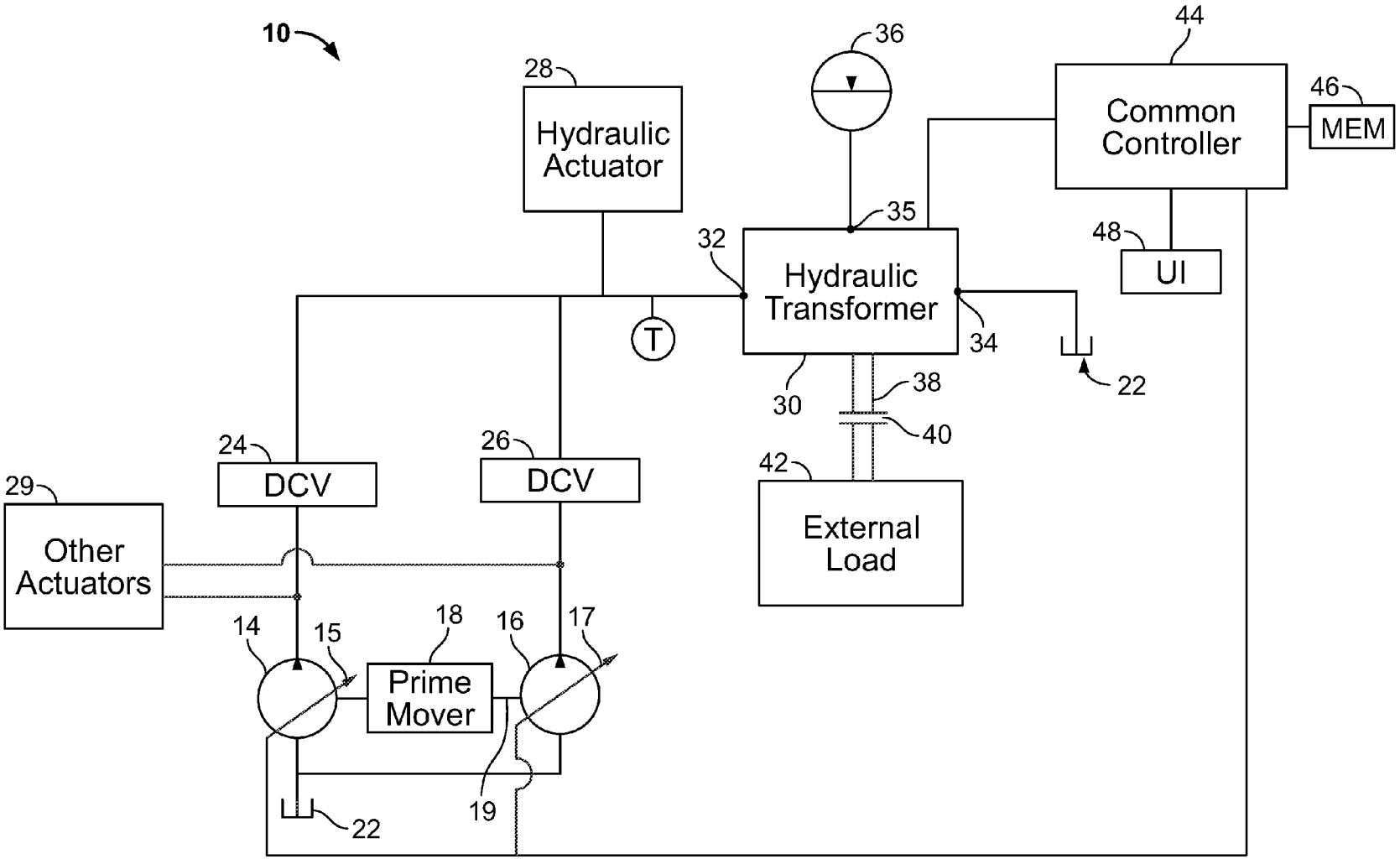
FIG. 1 is a schematic diagram of a first hydraulic system in accordance with the principles of the present disclosure.

FIG. 1 shows a hydraulic system 10 in accordance with the principles of the present disclosure. In general the hydraulic hybrid system 10 includes multiple variable displacement pumps 14, 16, directional control valves 24, 26, and a hydraulic transformer 30. Systems and methods described herein are implemented within the hydraulic system 10; however, it is understood that principles of the present disclosure are applicable to any hydraulic system where flow from multiple sources is combined to realize a desired flow rate.

The system 10 includes the variable displacement pumps 14, 16, driven by a prime mover 18. In some examples, two prime movers can be used to drive the variable displacement pumps 14, 16, respectively. Examples of the prime mover 18 include a diesel engine, a spark ignition engine, an electric motor or other power source. It is understood that in some embodiments, only one prime mover is needed to power both the variable displacement pumps 14, 16.

Each of the variable displacement pumps 14, 16 include inlets that draw low pressure hydraulic fluid from a tank 22 (i.e., a low pressure reservoir). The variable displacement pumps 14, 16 can include swash plates 15, 17 for controlling the pump displacement volume per shaft rotation. The variable displacement pumps 14, 16 draw the hydraulic fluid from the tank 22 and output pressurized hydraulic fluid for powering a first load, which is controlled by a first hydraulic actuator 28 (e.g., boom cylinder), a second load in the form of the hydraulic transformer 30 having a shaft 40 coupled to an external load 42, and a third load, which is controlled by other actuators 29. The variable displacement pumps 14, 16 include outlets through which the high pressure hydraulic fluid is output. The outlets are preferably fluidly coupled (directly or indirectly) to the plurality of different working load circuits, such as the first load, the second load, and the third load. In the present embodiment, the directional control valves 24, 26 control fluid flow between the load circuits (e.g., actuators or loads), the variable displacement pumps 14, 16, and the tank 22. It is understood that in other embodiments of the hydraulic system 10, more or less load circuits may exist in the system.

In some examples where the system 10 is used to operate an excavator, the first load includes a boom, which is actuated by the first actuator 28. The second load (the external load 42) includes a swing, which is operated by the transformer 30. The third load includes an arm, a bucket and a track motor, which are actuated by the other actuators 29.

The second load circuit includes the hydraulic transformer 30 including a first port 32, a second port 34, and a third port 35. The first port 32 of the hydraulic transformer 30 is indirectly connected to the outlet of the variable displacement pumps 14, 16 via the outlet of the directional control valves 24, 26. The first port 32 is also fluidly connected to the first actuator 28. The second port 34 is fluidly connected to the tank 22. The third port 35 is fluidly connected to a hydraulic accumulator 36.

The hydraulic transformer 30 further includes an output/input shaft 38 that couples to the external rotational load 42. In some examples, a clutch 40 can be used to selectively engage the output/input shaft 38 with the external load 42 and disengage the output/input shaft 38 from the external load 42. When the clutch 40 engages the output/input shaft 38 with the external load 42, torque is transferred between the output/input shaft 38 and the external load 42. In contrast, when the clutch 40 disengages the output/input shaft 38 from the external load 42, no torque is transferred between the output/input shaft 38 and the external load 42. In some embodiments, gear reductions may be provided between the clutch 40 and the external load 42. It is understood that in some embodiments of the hydraulic transformer 30, a clutch is not present.

In some embodiments, the other actuators 29 are fluidly connected between the variable displacement pumps 14, 16 and the directional control valves 24, 26. As the other actuators 29 run, the other actuators 29 change the pressures at the outlet of the variable displacement pumps 14, 16. In this configuration, by detecting the pressures changed by the other actuators 29, which are, for example, monitored by pressure sensors (P_pump1) 31 and (P_pump2) 33 (FIG. 2), the stream of the working fluid can be controlled to ensure a flow continuity, as described below in further detail.

The system 10 further includes an electronic controller 44 that interfaces with the variable displacement pumps 14, 16, the directional control valves 24, 26, and the hydraulic transformer 30. It will be appreciated that the electronic controller 44 can also interface with various other sensors and other data sources provided throughout the system 10. For example, the electronic controller 44 can interface with pressure sensors incorporated into the system 10 for measuring the hydraulic pressure in the accumulator 36, the hydraulic pressure provided by the variable displacement pumps 14, 16 to the plurality of actuators or loads in the system 10, the pressures at the pump and tank sides of the hydraulic transformer 30 and other pressures. Moreover, the controller 44 can interface with a rotational speed sensor that senses a speed of rotation of the output/input shaft 38 and the rotational speed of the transformer shaft. In some examples, the electronic controller 44 operates to control the variable displacement pumps 14, 16 by, for example, controlling the position of the swash plates 15, 17. In other examples, the electronic controller 44 can be used to monitor a load on the prime mover 18 and can control the hydraulic fluid flow rate across the variable displacement pumps 14, 16 at a given rotational speed of a drive shaft, for example, the drive shafts 19, powered by the prime mover 18. Thus, in some embodiments, the prime mover 18 is connected to the drive shafts 19. In one embodiment, the hydraulic fluid displacement across the variable displacement pumps 14, 16 per shaft rotation can be altered by changing positions of the swash plates 15, 17 of the variable displacement pumps 14, 16, respectively. The controller 44 can also interface with the clutch 40 for allowing an operator to selectively engage and disengage the output/input shaft 38 of the hydraulic transformer 30 with respect to the external load 42.

The electronic controller 44 includes a user interface 48 and a memory 46. A controller of the hydraulic system 10 may interact with the user interface 48 to control movement of the various machine components connected to the system, such as, the loads or actuators. In some embodiments, the user interface 48 may be arranged and configured to accept controller commands which determine the overall operation of the machine components. The user interface 48 may be any electronic or mechanical device capable of receiving commands from an operator, such as, for example, a computer, a joystick, and/or the like. The memory 46 can include various algorithms and control logic that is utilized by the electronic controller 44 in controlling the operation of the system 10. The memory 46 can also include one or more look-up tables that help in the computation of certain measurements, such as, for example, the desired flow of a system.

In some embodiments, the electronic controller 44 can control operation of the hydraulic transformer 30 so as to provide a load leveling function that permits the prime mover 18 to be run at consistent operating conditions (i.e., a steady operating condition) thereby assisting in enhancing an overall efficiency of the prime mover 18. The load leveling function can be provided by efficiently storing energy in the accumulator 36 during periods of low loading on one or more of the prime mover 18, and efficiently releasing the stored energy during periods of high loading on one or more of the prime mover 18. This allows the prime mover 18 to be sized for an average power requirement rather than a peak power requirement.

Figure 2:
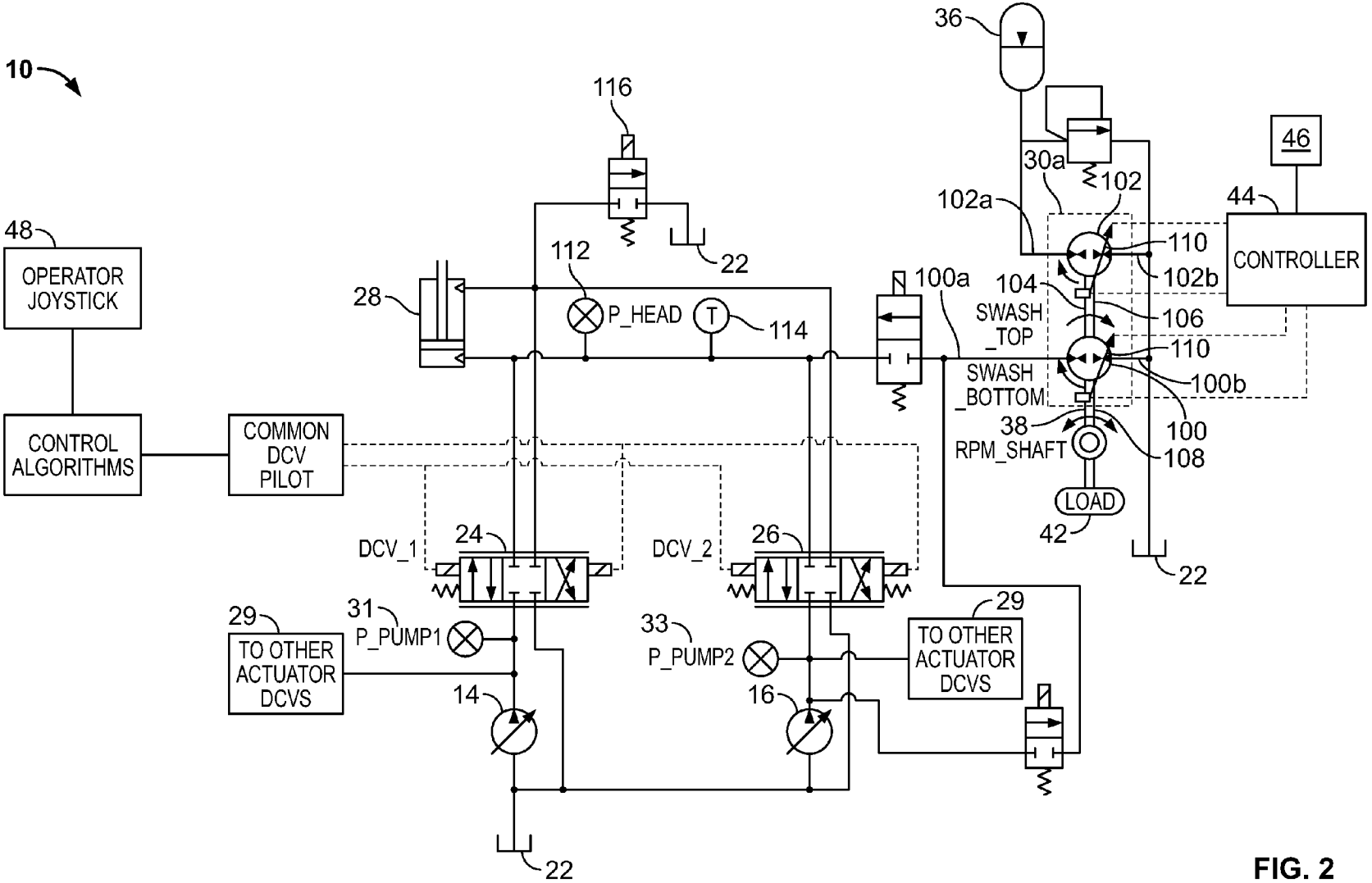
FIG. 2 is a schematic diagram of a second hydraulic system in accordance with the principles of the present disclosure.

FIG. 2 depicts an alternate embodiment of the system 10 of FIG. 1, equipped with a hydraulic transformer 30*a* having a plurality of pump/motor units connected by a common shaft. For example, the hydraulic transformer 30*a* includes first and second variable volume positive displacement pump/motor units 100, 102 connected by a shaft 104. The shaft 104 includes a first portion 106 that connects the first pump/motor unit 100 to the second pump/motor unit 102, and a second portion 108 that forms the output/input shaft 38. The first pump/motor unit 100 includes a first side 100*a* that is fluidly (and indirectly) connected to the variable displacement pumps 14, 16 and a second side 100*b* fluidly connected to the tank 22. The second pump/motor unit 102 includes a first side 102*a* fluidly connected to the accumulator 36 and a second side 102*b* fluidly connected to the tank 22.

In one embodiment, each of the first and second pump/motor units 100, 102 includes a rotating group (e.g., cylinder block and pistons) that rotates with the shaft 104, and a swash plate 110 that can be positioned at different angles relative to the shaft 104 to alter the amount of pump displacement per each shaft rotation. The volume of hydraulic fluid displaced across a given one of the pump/motor units 100, 102 per rotation of the shaft 104 can be changed by varying the angle of the swash plate 110 corresponding to the given pump/motor unit. Varying the angle of the swash plate 110 also changes the torque transferred between the shaft 104 and the rotating group of a given pump/motor unit. When the swash plates 110 are aligned perpendicular to the shaft 104, no hydraulic fluid flow is directed through the pump/motor units 100, 102. The swash plates 110 can be over-center swash plates that allow for bi-directional rotation of the shaft 104. The angular positions of the swash plates 110 are individually controlled by the electronic controller 44 based on the operating condition of the system 10. Thus, by controlling the positions of the swash plates 110, the controller 44 can operate the system 10 in several operating modes.

By controlling the displacement rates and displacement directions of the pump/motor units 100, 102, fluid power (pressure times flow) at a particular level can be converted to an alternate level, or supplied as shaft power used to drive the external load 42. When a deceleration of the external load 42 is desired, the hydraulic transformer 30*a* can act as a pump taking low pressure fluid from the tank 22 and directing it either to the accumulator 36 for storage, to the first actuator 28 connected indirectly to the variable displacement pumps 14, 16 via the directional control valves 24, 26, or a combination of the two. In some examples, similarly to the clutch 40 in FIG. 1, a clutch can be used to selectively disengage the output/input shaft 38 from the external load 42. In this configuration, the hydraulic transformer 30*a* can function as a stand-alone hydraulic transformer (e.g., a hydraulic transformer) when no shaft work is required to be applied to the external load 42. This is achieved by taking energy from the system 10 at whatever pressure is dictated by the other associated system loads (e.g., the first actuator 28) and storing the energy, without throttling, at the current accumulator pressure. In the same way, un-throttled energy can also be taken from the accumulator 36 at its current pressure and supplied to the system 10 at the desired operating pressure. Proportioning of power flow by the hydraulic transformer 30*a* can be controlled by controlling the positions of the swash plates 110 on the pump/motor units 100, 102. In certain embodiments, as depicted in FIG. 2, aspects of the present disclosure can be used in systems without a clutch for disengaging a connection between the output/input shaft 38 and the external load 42.

In some examples, the system 10 includes a rod-to-tank valve 116, which is fluidly connected between the rod side of the first actuator 28 and the tank 22. When power is drawn from the accumulator 36 to operate the second pump/motor unit 102 as a motor, the swash plate 110 rotates and the first pump/motor unit 100 operates to pump the working fluid from the tank 22 to the system loads (e.g., the first actuator 28). In particular, when the directional control valves 24, 26 are closed, the working fluid is supplied to the first actuator 28, which is operated to actuate a load, such as a boom. In this case, the working fluid contained in the top cavity of the first actuator 28 is drawn back from the rod side of the actuator 28 to the tank 22 through the rod-to-tank valve 116 as the actuator 28 works to actuate the load.

Figure 3:
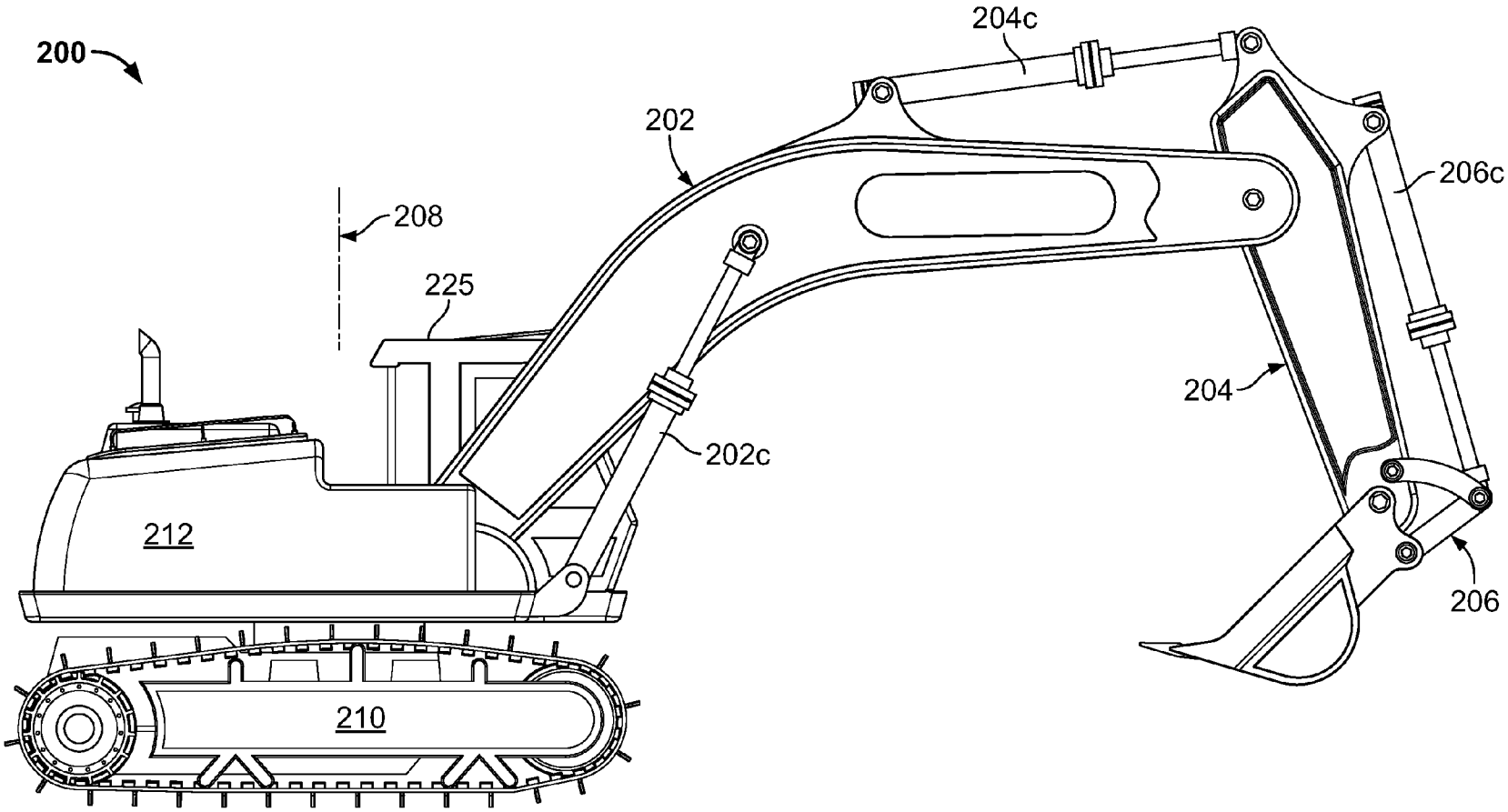
FIG. 3 shows a mobile piece of excavation equipment that is an example of one type of machine on which hydraulic systems in accordance with the principles of the present disclosure can be used.
Figure 4:
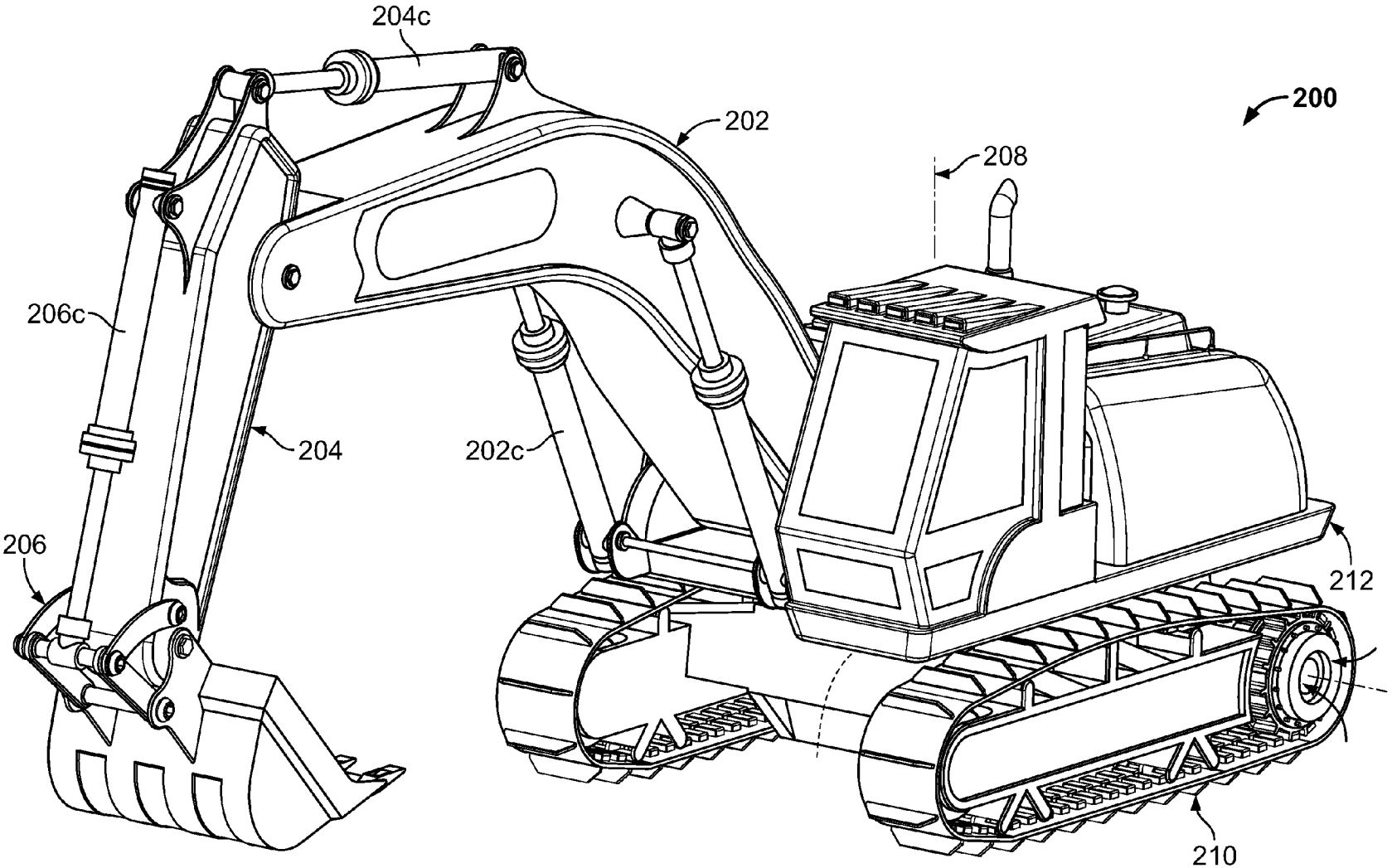
FIG. 4 shows an alternate view of the mobile piece of excavation equipment shown in FIG. 3.

FIGS. 3 and 4 depict an example embodiment of mobile excavation equipment which incorporates hydraulic circuit configurations of the type described above with reference to FIGS. 1 and 2. In particular, FIGS. 3 and 4 show an example excavator 200 including an upper structure 212 supported on an undercarriage 210. The undercarriage 210 includes a propulsion structure for carrying the excavator 200 across the ground. For example, the undercarriage 210 can include left and right tracks. The upper structure 212 is pivotally movable relative to the undercarriage 210 about a pivot axis 208 (i.e., a swing axis). In certain embodiments, transformer input/output shafts of the type described above can be used for pivoting the upper structure 212 about the swing axis 208 relative to the undercarriage 210.

The upper structure 212 can support and carry the prime mover (e.g., prime mover 18) of the machine and can also include a cab 225 which may include an operator interface, such as, for example, the user interface 48. A boom 202 is carried by the upper structure 212 and is pivotally moved between raised and lowered positions by a boom cylinder 202*c*. An arm 204 is pivotally connected to a distal end of the boom 202. An arm cylinder 204*c* is used to pivot the arm 204 relative to the boom 202. The excavator 200 also includes a bucket 206 pivotally connected to a distal end of the arm 204. A bucket cylinder 206*c* is used to pivot the bucket 206 relative to the arm 204. In some embodiments, the boom cylinder 202*c*, the arm cylinder 204*c*, and the bucket cylinder 206*c* may be part of system load circuits of the type described above. In some embodiments, the first load 28 can function as the boom cylinder 402*c*.

In some instances, hybrid hydraulic systems, such as the ones shown in FIGS. 1 and 2, require extra functionality to achieve increased fuel efficiency. It is desirable for this extra functionality to be transparent to an operator of the system, such as the operator of the excavation equipment shown in FIGS. 3 and 4. In other words, transitions between operating modes of the system should be smooth instead of sporadic and jerky so that the operator is unaware of mode transitions. A primary cause of undesirable dynamic responses that create such problems during mode transitions is the scheduling of flow sources. For example, as the system is recovering energy from an overrunning load (e.g., when actuators allow the load to free fall when the directional valve that controls the actuator shifts to lower the load), flow may need to move through the hydraulic transformer 30*a* to enable energy recover and storage. However, if the swing is rotating at a set speed, the hydraulic transformer may not be sufficient to supply all of the flow necessary to maintain the desired boom speed. In this instance, it is beneficial for at least some of the flow to be sent through the alternate sources, such as, for example, the directional control valves 24, 26.

Figure 5:
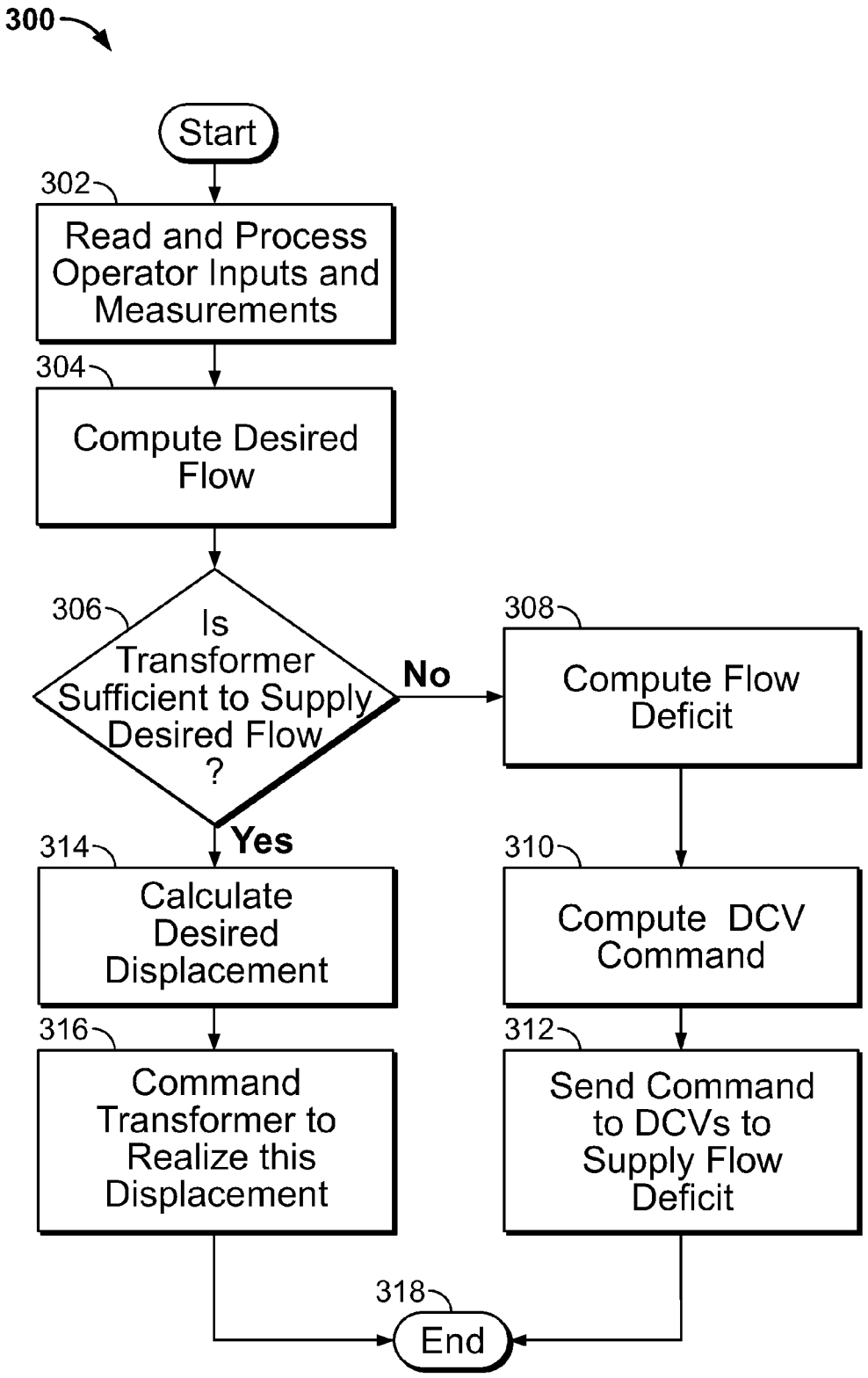
FIG. 5 is an example logic flow chart for operating example control systems that may be used to control certain hydraulic systems in accordance with the principles of the present disclosure.
Figure 6:
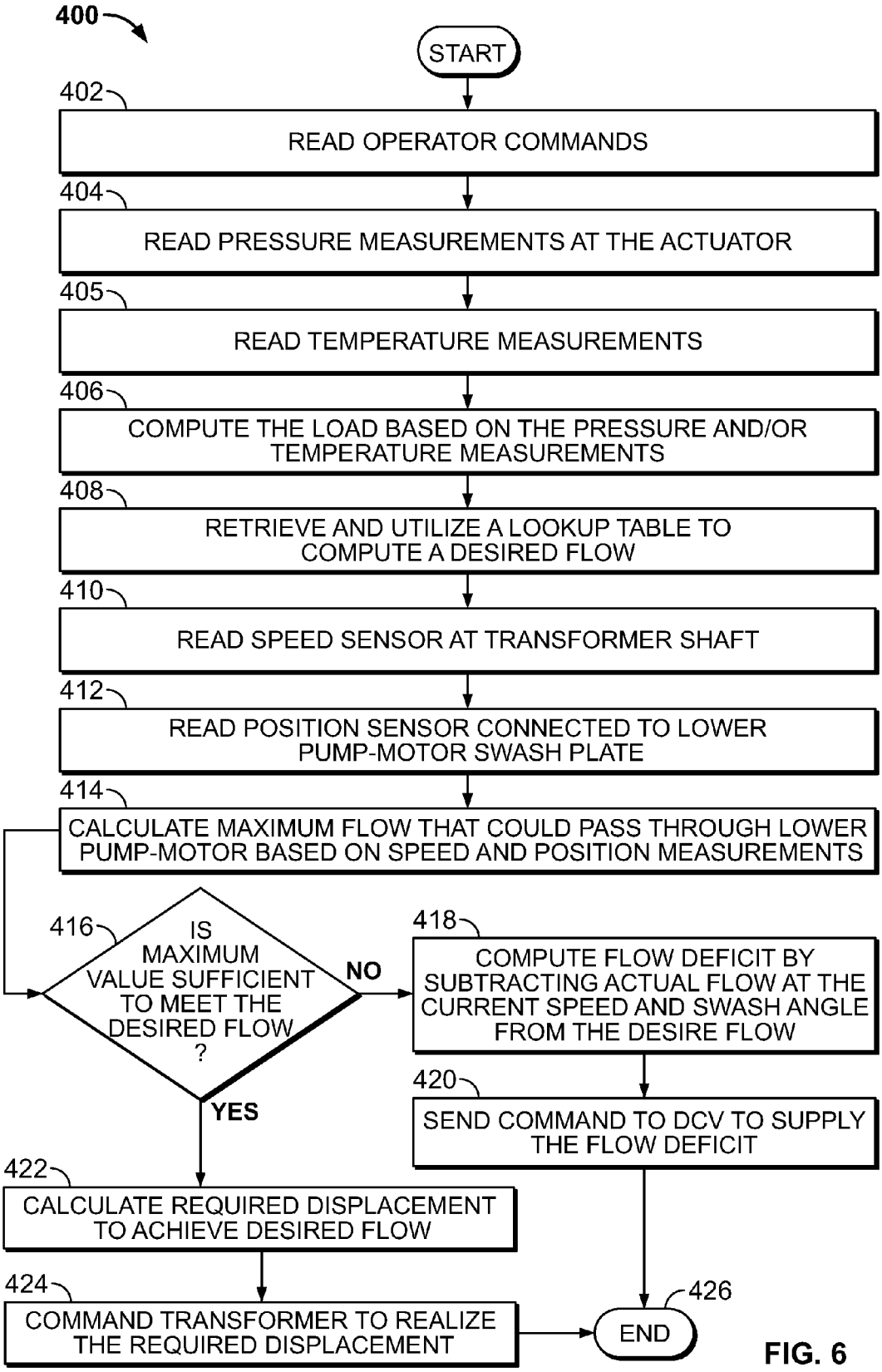
FIG. 6 is another example logic flow chart for operating example control systems that may be used to control certain hydraulic systems in accordance with the principles of the present disclosure.

Now referring to FIGS. 5 and 6, example logic flow charts depicting method 300 and 400 for operating a hydraulic system with flow sharing are shown. It is understood that a control system, such as the electronic controller 44 is arranged and configured to control the hydraulic system, such as the hydraulic system 10. The methods 300 and 400 are example methods of operation of the control system. A primary goal of the control logic/architecture is to improve operator transparency during operation of the hybrid hydraulic system or machinery that implements the hybrid hydraulic system. In particular, the methods 300 and 400 are example methods of reducing dynamic responses due to inadequate and/or inefficient scheduling of flow sources by causing flow sharing between multiple sources. The methods 300 and 400 will be described with reference to the hybrid hydraulic system 10 described in FIG. 2; however, the methods 300 and 400 may be implemented in any hydraulic system.

It is further understood that the controller 44 may be any device suitable to process digital and/or analog instructions, such as, for example, a computing device, and implement the methods 300 and 400. In some embodiments, the controller 44 includes at least some form of computer-readable media. Computer readable media includes any available media that can be accessed by the controller 44. By way of example, computer-readable media include computer readable storage media and computer readable communication media.

Computer readable storage media includes volatile and nonvolatile, removable and non-removable media implemented in any device configured to store information such as computer readable instructions, data structures, program modules or other data. Computer readable storage media includes, but is not limited to, random access memory, read only memory, electrically erasable programmable read only memory, flash memory or other memory technology, compact disc read only memory, digital versatile disks or other optical storage, magnetic cassettes, magnetic tape, magnetic disk storage or other magnetic storage devices, or any other medium that can be used to store the desired information and that can be accessed by the controller 44, such as, for example, the memory 46 which may include a plurality of instructions for operating the system 10, control algorithms, stored measurements, and the like.

Computer readable communication media typically embodies computer readable instructions, data structures, program modules or other data in a modulated data signal such as a carrier wave or other transport mechanism and includes any information delivery media. The term "modulated data signal" refers to a signal that has one or more of its characteristics set or changed in such a manner as to encode information in the signal. By way of example, computer readable communication media includes wired media such as a wired network or direct-wired connection, and wireless media such as acoustic, radio frequency, infrared, and other wireless media. Combinations of any of the above are also included within the scope of computer readable media.

Now referring to FIG. 5, the method 300 begins at operation 302 when the controller 44 receives, reads, and processes operator inputs and measurements. In particular, the operator may request actions via the user interface 48. In addition, an operator input may be, for example, the pilot pressure delta generated by a hydraulic joystick acting on each directional control valve 24, 26 or other pressure changes generated by movement of the joystick by the operator. The controller 44 may also read measurements, such as the head-side pressure, and/or temperature, at the actuator to compute the load. In some embodiments, a head-side pressure transducer 112 can be used to measure the head-side pressure at the actuator, and a head-side temperature transducer 114 can be used to measure the head-side temperature at the actuator. In other embodiments, a rod-side pressure transducer may be read for precise load estimation.

After completing the operation 302, the method 300 moves to operation 304 at which the controller 44 computes the desired flow based on the operator's inputs, measurements, and load estimation. For example, based on the operator's joystick commands and the estimation of the actuator load, the controller 44 retrieves and utilizes a look-up table. Based on the information retrieved from the look-up table, the controller 44 computes the desired flow.

The method 300 then moves to operation 306 at which the controller 44 determines whether the hydraulic transformer 30*a* is sufficient to independently supply the desired flow computed at the operation 304. To properly make the determination, the controller 44 takes one or more measurements to determine the maximum flow that could pass through the hydraulic transformer 30*a* without negative dynamic responses. At the operation 306, the controller 44 compares the desired flow with the maximum flow to determine whether the maximum flow is sufficient to meet the desired flow.

If the maximum flow is not sufficient to meet the desired flow, the method 300 moves to operation 308. At the operation 308, the transformer is set to its maximum flow and the controller 44 computes a flow deficit that needs to be supplemented by alternate sources. The flow deficit is the amount of flow that is needed beyond the maximum flow of the hydraulic transformer 30*a* and is the amount that will be mitigated by flow from other sources, such as, for example, the directional control valves 24, 26.

At operations 310 and 312, the flow deficit is converted into a command that is sent from the controller 44 to the directional control valves 24, 26. The amount of flow requested from each of the directional control valves 24, 26, can be either the same or different amounts. The command is received at the directional control valves 24, 26 and the requested amount of flow is supplied to the system.

If, however, the maximum flow of the hydraulic transformer 30*a* is sufficient to supply the computed desired flow, the method 300 moves to operation 314 instead of the operation 308. At the operation 314, the controller 44 computes the displacement required to achieve the desired flow and converts this desired flow into a command. At the operation 316, this command is sent to the hydraulic transformer 30*a* which realizes the requested displacement and supplying the desired flow for the action.

Upon completing either the operation 312 or the operation 316, the method 300 ends at operation 318. In some embodiments of the method 300, the controller 44 may continuously operate in accordance with the method 300 within a predetermined or arbitrary amount of time. In yet other embodiments, the controller 44 may begin the operation 300 again only after receiving new inputs from the operator via the user interface 48.

Now referring to FIG. 6, the method 400 begins at operation 402 at which the controller 44 reads operator commands. As stated above with reference to the operation 302 in the method 300, the controller 44 receives, reads, and processes operator inputs such as the ones described herein.

At operation 404, the controller 44 reads pressure measurements at the actuator. Such pressure measurements include the head-side pressure at the actuator, and can be read utilizing a head-side pressure transducer, a rod-side pressure transducer, or the like.

In some examples, at operation 405, the controller 44 also reads temperature measurements at the actuator. Such temperature measurements can include the head-side temperature at the actuator, and can be read utilizing a head-side temperature transducer 114, a rod-side temperature transducer, or the like.

The method 400 then moves to operation 406 at which the controller 44 computes the load based on the pressure and/or temperature measurements read at the operation 404.

At operation 408, the controller retrieves and utilizes a lookup table for the purpose of computing a desired flow. The lookup table may be an operation map that correlates certain measurements, such as, load estimations to flow. The controller 44 may, based on the operator commands read at the operation 402, the measurements read at the operation 404, and/or the computed load estimation at the operation 406, utilize the lookup table to correlate one or more of these inputs with a flow. In some embodiments, this flow is the desired flow.

At operations 410, 412, and 414, the controller 44 reads speed sensors at the transformer shaft 38, reads one or more position sensors connected to the lower pump-motor swash plate, and calculates a maximum flow that could pass through the lower pump-motor of the hydraulic transformer 30*a* based on the speed and displacement position measurements taken in the operations 410 and 412. In some embodiments, at the operation 414, the controller 44 calculates the maximum flow by multiplying the speed read from the speed sensor by a maximum possible displacement of the hydraulic transformer 30*a*.

At operation 416, the controller 44 determines whether the maximum flow calculated in the operation 414 is sufficient to meet the desired flow calculated in the operation 408. If the maximum flow is not sufficient to meet the desired flow, the method 400 moves to operation 418. At the operation 418, in some embodiments, the controller 44 computes a flow deficit by subtracting an actual flow at the current speed and swash angle from the desired flow. This is the flow deficit that must be mitigated by flow across the directional control valves 24, 26.

At the operation 420, the flow deficit is converted into a command that is sent to the directional control valves 24, 26, which in turn, supply the flow deficit to the system 10. The command sent to the directional control valves 24, 26 may differ based on the status and/or configuration of the system 10 and/or valves 24, 26. For example, in some embodiments, one of the directional control valves 24, 26 is coupled to the tank 22 and the other is blocked for at least one of a number of reasons. In the case of flow recovery, a pilot pressure command can be computed utilizing an orifice equation as shown in Equation 1 below. In particular, using the orifice equation, the controller 44 computes a desired orifice area needed to achieve the desired flow based on head-side pressure and tank pressure measurements taken from sensors.

$$A_DESIRED = Q_DEFICIT/(Cd*SQRT([P_HEAD - P_TANK]*(2/RHO))), \quad (1)$$

where A_DESIRED is a desired orifice area, Q_DEFICIT is the flow deficit, Cd is the discharge coefficient, P_HEAD is the head-side actuator pressure, P_TANK is tank pressure, and RHO is fluid density.

A lookup table, which correlates orifice area to pilot pressure delta, is then used to determine the pilot pressure delta for the orifice connected head-side to the tank 22. In some embodiments, the lookup table is a computerized function which can be utilized to tabulate the pilot pressure delta that is required for a given orifice area, such as, in this case, the orifice connecting head-side to tank). An example of such a function is shown in Equation 2 below.

$$X_DCV = F_PP(A_DESIRED), \quad (2)$$

where X_DCV is the pilot pressure delta, F_PP (A) is the lookup table, which in this case, accepts the desired orifice area calculated via Equation 1 as an input. This desired pilot pressure delta across the boom directional flow control valve is achieved using electronically controlled pressure control valves.

In an alternate configuration, both of the directional control valves 24, 26 have orifices connecting their respective pumps 14, 16 to the head-side of the actuator. The controller 44 may utilize an optimization-based algorithm to compute the optimum pilot pressure command to send to both of the control valves 24, 26. In this example, the command is based on pressure sensor measurements at the head-side of the actuator, the outlet of the pump 14, the outlet of the pump 16. In particular, Equations 3, 4, and 5, in conjunction with lookup tables created using test data prior to system commissioning, may be utilized to determine the optimum pilot pressure in a flow supply case as described above.

$$X_DCV - ARGMIN_X\{A1(X) + A2(X)*SQRT(DP2)/SQRT(DP1) - Q_DEFICIT/(Cd*SQRT(DP1*2/RHO))\}, \quad (3)$$

$$DP1 = P_PUMP1 - P_HEAD, \quad (4)$$

$$DP2 = P_PUMP2 - P_HEAD, \quad (5)$$

where ARGMIN_X is the function that retrieves the value of X that minimizes the function, A1(X) is the area-versus-pilot pressure delta map for the orifice on the DCV connecting pump 14 to head-side, and A2(X) is the area-versus-pilot pressure delta map for the orifice on the other DCV connecting pump 16 to head-side. The X_DCV command is realized at the directional control valves 24, 26 pilot ports via pressure control, for example, using electro-proportional pressure relief valves in closed loop control. The computed command, in either scenario, is sent to the actuators, and the algorithm concludes at the end operation 426.

If, however, the maximum flow is sufficient to meet the desired flow, the method 400 moves to the operations 422 and 424. The operations 422 and 424 of the method 400 are the same or substantially the same as the operations 314 and 316 of the method 300. Upon completing either the operation 420 or the operation 424, the method 400 ends at operation 426. In some embodiments of the method 400, the controller 44 may continuously operate in accordance with the method 400 and repeat the method at sample times. In yet other embodiments, the controller 44 may begin the operation 400 again only after receiving new inputs from the operator via the user interface 48.

What is claimed is:

1. A hydraulic system comprising:

a tank;

at least one system pump powered by at least one prime mover and coupled to the tank;

a first directional flow control valve coupled to the at least one system pump;

an accumulator;

a hydraulic transformer in selective fluid communication with the at least one system pump, the hydraulic transformer including first and second displacement pump units connected to a shaft, the shaft being connected to a first load, the first displacement pump unit including a first side that selectively fluidly connects to at least one of the at least one system pump and a second side that fluidly connects to the tank, the second displacement pump unit including a first side that fluidly connects to the accumulator and a second side that fluidly connects with the tank;

a second load driven by an actuator in selective fluid communication with the at least one system pump and the hydraulic transformer; and a controller arranged and configured to reduce dynamic responses in the hydraulic system by causing flow sharing between the hydraulic transformer and the first directional flow control valve, the controller having a memory with a set of instructions, wherein the controller is arranged and configured to execute the set of instructions to implement a method for flow sharing, the method comprising:

receiving and reading operator inputs;

computing a load value indicative of the second load based on the pressure measurements;

computing a desired flow based on the load value;

determining whether the hydraulic transformer is sufficient to independently supply the desired flow;

if the hydraulic transformer is not sufficient to independently supply the desired flow:

computing a flow deficit; and computing and sending a command to the first directional flow control valve indicative of the flow deficit; and if the hydraulic transformer is sufficient to independently supply the desired flow:

computing a desired displacement for the hydraulic transformer; and computing and sending a second transformer command to the hydraulic transformer to realize the desired displacement.

2. The hydraulic system of claim 1, further comprising:

a second system pump powered by the at least one prime mover and coupled to the tank; and a second directional flow control valve coupled to the second system pump.

3. The hydraulic system of claim 2, wherein the method implemented by the controller further comprises:

computing and sending a second valve command to the second directional flow control valve indicative of at least a portion of the flow deficit.

4. The hydraulic system of claim 1, wherein the method implemented by the controller further comprises:

reading pressure measurements at the actuator.

5. The hydraulic system of claim 1, wherein the method implemented by the controller further comprises:

reading temperature measurements at the actuator.

6. The hydraulic system of claim 1, wherein when the system is recovering energy from an overrunning load, the command is computed based on a desired orifice area.

7. The hydraulic system of claim 6, wherein the memory further comprises:

a look-up table, and the method implemented by the controller further comprises:

retrieving the look-up table; and utilizing the desired orifice area as an input to the look-up table to determine at least a portion of the command.

8. The hydraulic system of claim 1, wherein the method implemented by the controller further comprises:

reading speed measurements at the shaft.

9. The hydraulic system of claim 1, wherein the method implemented by the controller further comprises:

reading displacement position measurements of at least one of the first and second displacement pump units.

10. The hydraulic system of claim 1, wherein determining whether the hydraulic transformer is sufficient to independently supply the desired flow comprises:

calculating a maximum flow that can be supplied by the hydraulic transformer.

11. The hydraulic system of claim 1, wherein computing the flow deficit comprises:

subtracting an actual flow at a current speed and current position from the desired flow.

12. The hydraulic system of claim 1, further comprising a third load driven by a second actuator in selective fluid communication with the at least one system pump.

13. The hydraulic system of claim 1, further comprising a third load driven by a second actuator in selective fluid communication with the at least one system pump and the hydraulic transformer, the second actuator is connected between the at least one system pump and the first directional flow control valve.

14. The hydraulic system of claim 1, wherein the first directional flow control valve and the desired displacement for the hydraulic transformer are controlled to enable the hydraulic system to share flow smoothly between multiple power sources, loads, and energy storage elements.

* * * * *